US009170598B2

(12) United States Patent
Goetze

(10) Patent No.: US 9,170,598 B2
(45) Date of Patent: Oct. 27, 2015

(54) FOLDING HANDLE FOR LIFT AND SLIDE DOOR

(75) Inventor: Timothy Goetze, Mount Vernon, KY (US)

(73) Assignee: F.P.L. DOORLOCK HARDWARE, INC., Mount Vernon, KY (US)

( * ) Notice: Subject to any disclaimer, the term of this patent is extended or adjusted under 35 U.S.C. 154(b) by 161 days.

(21) Appl. No.: 13/427,173

(22) Filed: Mar. 22, 2012

(65) Prior Publication Data

US 2012/0240718 A1 Sep. 27, 2012

Related U.S. Application Data

(60) Provisional application No. 61/466,237, filed on Mar. 22, 2011.

(51) Int. Cl.
*E05B 3/00* (2006.01)
*G05G 1/04* (2006.01)

(52) U.S. Cl.
CPC ..... *G05G 1/04* (2013.01); *Y10T 74/20612* (2015.01); *Y10T 74/20618* (2015.01)

(58) Field of Classification Search
CPC ..... E05B 5/00; E05C 19/14; G05G 1/04; Y10T 74/20612; Y10T 74/20618
USPC ..... 292/1, 336.3, DIG. 12, DIG. 31, DIG. 49; 70/208; 49/460, 226; 16/110.1, 113.1, 16/405, 408, 412, 415, 422, 426, 427, 429, 16/438, 439
See application file for complete search history.

(56) References Cited

U.S. PATENT DOCUMENTS

| | | | | | |
|---|---|---|---|---|---|
| 967,377 | A * | 8/1910 | Henry | 292/142 |
| 1,332,193 | A * | 3/1920 | Anderson | 292/26 |
| 1,684,499 | A * | 9/1928 | Mayer | 292/336.3 |
| 2,131,458 | A * | 9/1938 | Turner | 292/165 |
| 3,259,412 | A * | 7/1966 | Wheeler | 292/113 |
| 5,172,520 | A * | 12/1992 | Hostetler et al. | 49/449 |
| 5,355,554 | A * | 10/1994 | Magoon | 16/412 |
| 5,653,483 | A * | 8/1997 | Grover | 292/194 |
| 6,490,896 | B2 * | 12/2002 | Segawa | 70/208 |
| 6,953,209 | B2 * | 10/2005 | Jackson et al. | 292/66 |
| 7,155,861 | B2 * | 1/2007 | Berry et al. | 49/225 |
| 8,496,277 | B2 * | 7/2013 | Commons et al. | 292/336.3 |
| 8,533,997 | B2 * | 9/2013 | Stoutenborough et al. | 49/235 |
| 2005/0206176 | A1 * | 9/2005 | Ooe et al. | 292/336.3 |
| 2010/0066052 | A1 * | 3/2010 | Plett et al. | 280/164.1 |
| 2010/0109352 | A1 * | 5/2010 | Tien et al. | 292/336.3 |
| 2011/0000138 | A1 * | 1/2011 | Stoutenborough et al. | 49/449 |
| 2011/0156411 | A1 * | 6/2011 | Commons et al. | 292/336.3 |

FOREIGN PATENT DOCUMENTS

| | | | | |
|---|---|---|---|---|
| DE | 4402479 C1 * | 4/1995 | | E05C 9/10 |
| EP | 1076140 A1 * | 2/2001 | | E05B 1/00 |
| FR | 2844539 * | 3/2004 | | |

* cited by examiner

*Primary Examiner* — Kristina Fulton
*Assistant Examiner* — Nathan Cumar
(74) *Attorney, Agent, or Firm* — King & Schickli, PLLC

(57) ABSTRACT

An apparatus for use with a door adapted to lift and slide. The apparatus includes a base connected to the door and a lever hingedly connected to the base for maneuvering the door. The lever is positioned within the base such that the lever is fully recessed in the base. In use, the lever may be extended away from the base and folded into an operating position for moving the door.

18 Claims, 11 Drawing Sheets

FOLDING HANDLE FOR LIFT AND SLIDE DOOR

This application claims the benefit of U.S. Provisional Patent Application Ser. No. 61/466,237, filed on Mar. 22, 2011, the disclosure of which is incorporated herein by reference.

FIELD OF THE INVENTION

This disclosure relates generally to sliding doors and, more particularly, to a folding handle that may be stored substantially flush with a door adapted to lift and slide such that the handle is out of the way while still being connected to the door.

BACKGROUND OF THE INVENTION

Generally, swinging patio doors and conventional two-panel sliding doors have been used to open homes up to the outdoors to create an indoor/outdoor connection. However, these traditional sliding doors are being replaced by lift and slide doors which offer a number of benefits ranging from appearance to functionality. A lift and slide door operates similar to a standard sliding door except it utilizes a roller system that allows the door panels to be lifted vertically above the track, so that the panels roll smoothly and quietly for opening and closing. As a result, a lift and slide door can efficiently divide and/or unify interior spaces of a house with exterior spaces of the house.

Unlike traditional patio and sliding doors, lift and slide doors are more aesthetically pleasing as they may be completely hidden from view. For example, lift and slide doors allow the homeowner to open up an entire wall of the house to the outside such that the view is unobstructed as the door panels are hidden (i.e., the panels can either nest behind one another and stored to one side or disappear completely from view by being positioned inside an exterior wall cavity). Lift and slide doors are commonly being used in warm climates and coastal areas to integrate the interior of the house with a sun room or rooms with an ocean view or the like. Not only do lift and slide doors allow for spectacular views of the surroundings, but they are being used to easily integrate a garden, balcony or surrounding areas with the interior of the house in order to provide the benefits of natural light into the home.

Advantageously, lift and slide doors maximize valuable living space while providing superior weather resistance properties. Namely, lift and slide doors provide superior sealing, which increases energy efficiency and, in turn, decreases heating and cooling costs. Finally, lift and slide doors are versatile as they may come in a variety of sizes, styles, panel configurations, materials, colors and other options to accommodate a particular homeowner's desires.

A common type of lift and slide door system includes a plurality of door panels, which may be stored to one side or "pocketed" inside an exterior wall cavity when desired. The system uses an interlocking mechanism to couple the panels together so that the entire system opens and closes on stainless steel rollers or a track system. Specifically, the lift and slide door sits on grooved rollers that carry the door along a track in the floor. When locked, the rollers retract and the lift and slide door eases down, compressing a sill gasket on each side of the track. Simultaneously, wedge-shaped locking pins pull the door to one side, compressing the gaskets on each side. Further, the pins engage in the jamb at multiple points along the leading edge of the locking panel for providing a secure connection. Once open, the door may be lowered at any position and locked and sealed by moving the handle up.

Generally, a handle is used with a lift and slide door in order to unlock the door, move the door into a desired position and then lock the door once it is in the desired position. The handle typically protrudes from the door so an operator can grasp the handle in order to move and lock the door. One significant limitation associated with this type of handle is its protruding nature, which creates certain disadvantages. For example, the handle is not hidden from view, so it creates aesthetic issues. As the handle is not flush with door, it can be bumped into by persons or the handle may catch on clothing items or articles of furniture being moved into the room.

In addition, when multiple panels in a lift and slide door system roll parallel to another, the protruding handle on the door's stile prohibits the same doors to bypass one another. This limitation of not being able to bypass one another requires a deeper wall cavity for storage when the panels are nested in a wall cavity. Since the door panels are stopped by the protruding nature of the handles on opposite door, a deeper wall cavity is required because the doors have to be staggered in the wall cavity. Consequently, the deeper wall cavity takes up valuable living space in this arrangement.

In order to address these limitations associated with the handle not being flush with the lift and slide door, the handle may be removable from the door. However, this creates other problems, such as requiring an additional step to remove the handle and then reattach the handle when the door is to be moved. Furthermore, the inconvenience associated with attaching and removing the handle may be further complicated if the handle is misplaced or lost, which is not only time-consuming but expensive if the handle must be replaced.

Accordingly, a need is identified for a handle for a lift and slide door, which may be stored substantially flush with the door such that it is out of the way while still being connected to the door while maximizing living space.

SUMMARY OF THE INVENTION

The above-mentioned and other problems become solved by applying the principles and teachings associated with the hereinafter described folding handle.

In accordance with one aspect of the disclosure, an apparatus for use with a door adapted to lift and slide is provided. The apparatus includes a base adapted to be connected to the door and a lever hingedly connected to the base for maneuvering the door. The lever is positionable within the base such that the lever is fully recessed in the door.

Another related aspect of the disclosure is a folding handle assembly for a door adapted to lift and slide. The folding handle assembly includes a base for being attached to the door in a substantially flush condition. The base also has a recessed portion. The folding handle assembly includes a lever for being connected to the door having a tapered end for moving the door. The lever is configured to be positioned in the recessed portion of the base in a stored position substantially flush to a surface of the door.

A further aspect of the disclosure is an improvement in a lift and slide door having a base connected thereto. The base has a recessed portion. Specifically, the improvement comprises a folding handle stored substantially flush to a surface of the door in the recessed portion of the base. Further, the folding handle is configured to extend from the base to an operating position for moving the door.

Still other objects of the present invention will become apparent to those skilled in the art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects, all without departing from the invention. Accordingly, the drawings and description will be regarded as illustrative in nature and not as restrictive.

BRIEF DESCRIPTION OF THE DRAWINGS

The accompanying drawings incorporated in and forming a part of the specification, illustrates several aspects of the present invention, and together with the description serve to explain the principles of the invention. In the drawings.

DETAILED DESCRIPTION OF THE INVENTION

In the following detailed description, reference is made to the accompanying drawing that forms a part hereof, and in which is shown by way of illustration, specific embodiments in which the invention may be practiced. These embodiments are described in sufficient detail to enable those skilled in the art to practice the invention and like numerals represent like details in the various figures. Also, it is to be understood that other embodiments may be utilized and that process or other changes may be made without departing from the scope of the present invention. The following detailed description is, therefore, not to be taken in a limiting sense, and the scope of the present invention is defined only by the appended claims and their equivalents. In accordance with this disclosure, a folding handle for a lift and slide door is hereinafter described.

Figure 1:
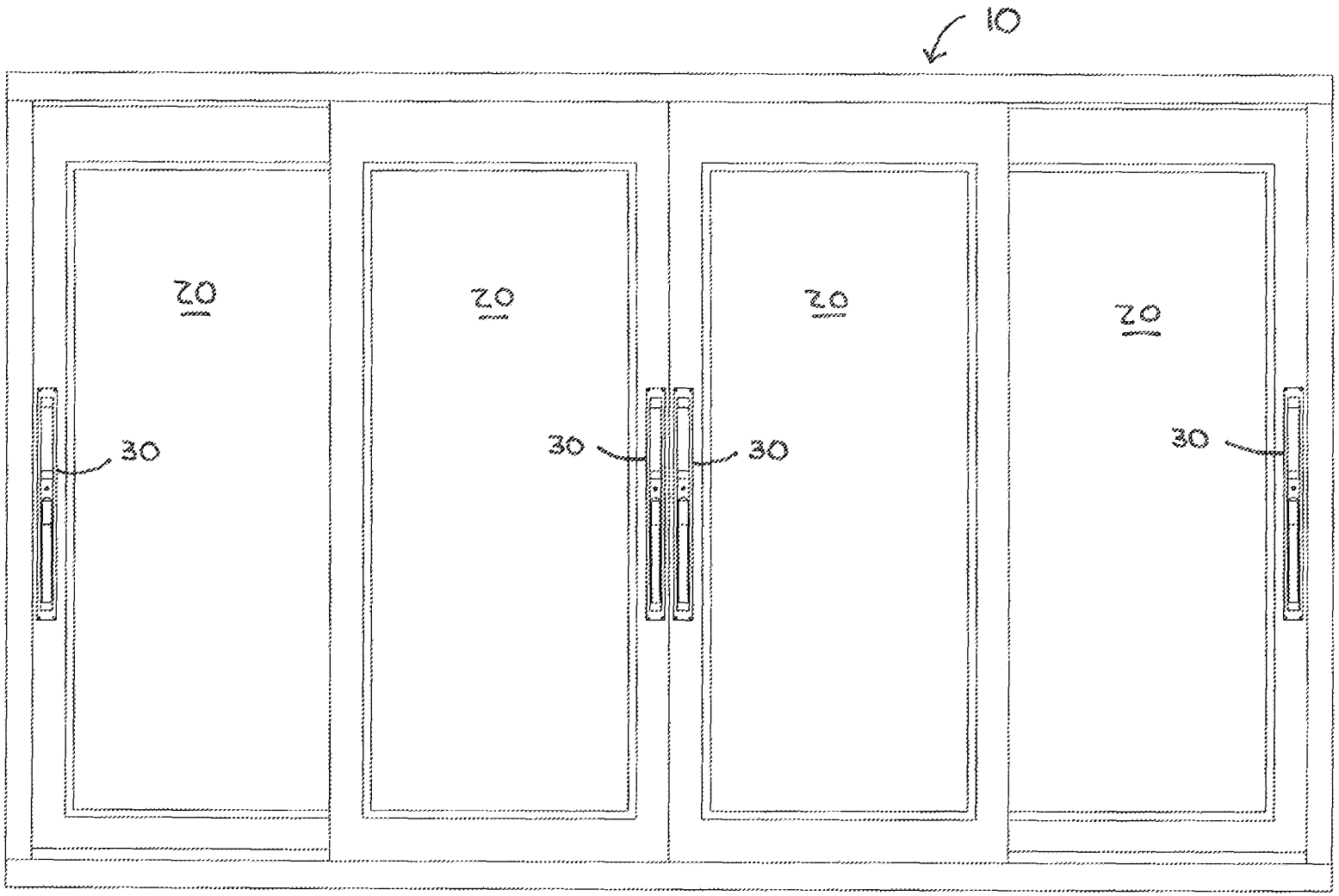
FIG. 1 is a front view in accordance with one embodiment of the present invention of a representative lift and slide door.
Figure 2:
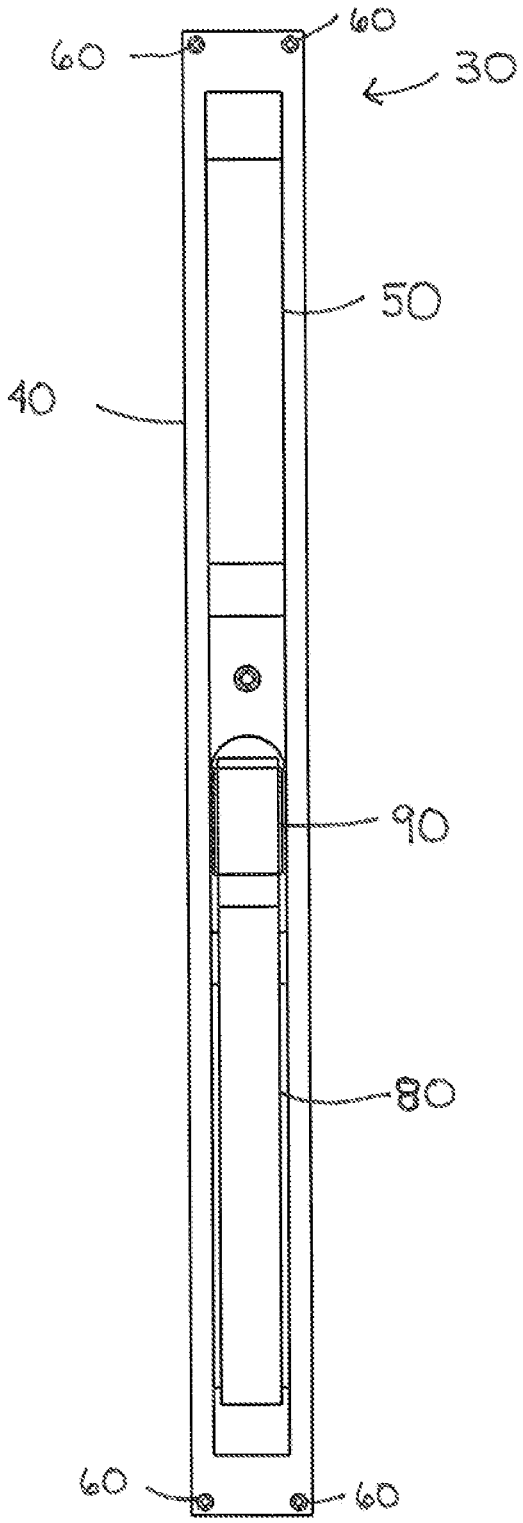
FIG. 2 is a front view in accordance with one embodiment of the present invention of a folding handle assembly.
Figure 3:
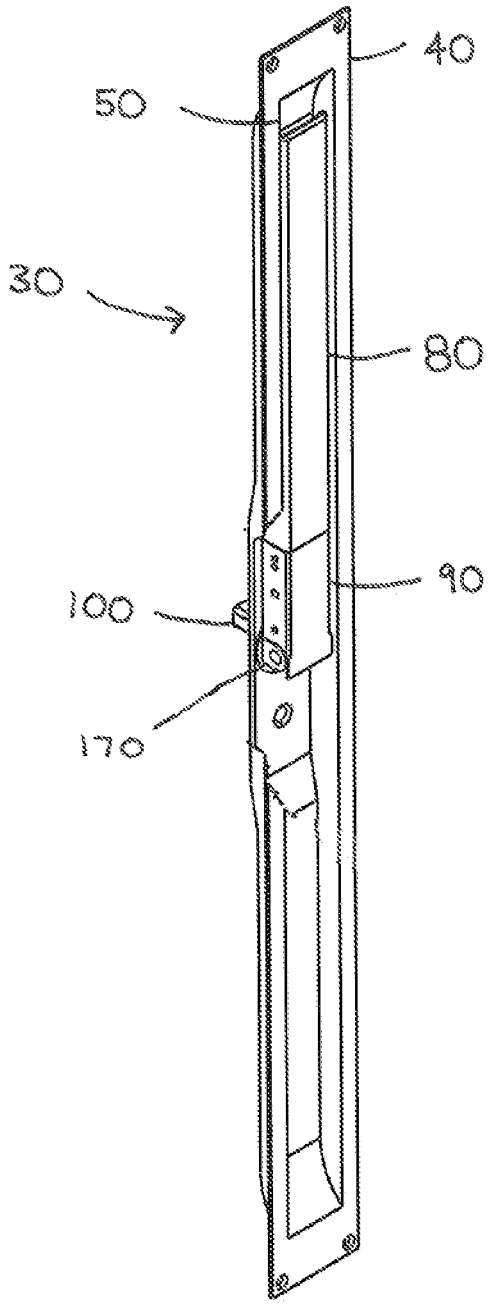
FIG. 3 is a perspective front view in accordance with one embodiment of the present invention of the folding handle assembly.

As shown in FIG. 1, a representative lift and slide door system 10 having a plurality of interconnected panels 20 is illustrated. Each of the individual panels 20 of the lift and slide door 10 has a folding handle assembly 30 for a person to use to open, close and lock the door. The entire handle assembly 30 is made of a rigid material, such as steel or a similar metal. Turning to FIGS. 2 and 3, the handle assembly 30 includes a trim or base section 40 attached to the door 10 in a substantially flush condition. The base 40 is typically positioned in the front face of the lift and slide door 10. Further, the base 40 is located substantially in the center of the front face of the door.

In more detail, the base 40 is substantially rectangular with a recess 50, which is also substantially rectangular. The recess 50 extends from approximately from one end of the base 40 to a second, opposite end of the base. In the illustrated embodiment, the recess 50 covers approximately 90% of the entire length of the base 40 and is completely within the perimeter of the base. However, it should be appreciated that the recess may vary in size depending on the size of the handle. The base 40 may be attached by any suitable means to the face of the lift and slide door. For example, in one embodiment, the base 40 is screwed directly to the door 10. As shown in FIG. 2, each of the four corners of the base 40 has an opening 60 for inserting a screw or other type of fastener through to suitably attach the base to the door 10.

Figure 4:
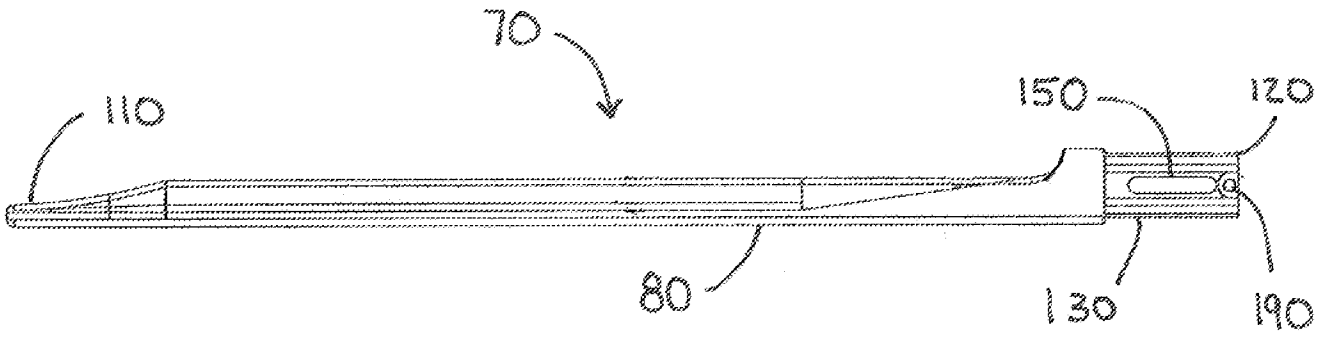
FIG. 4 is a side view in accordance with one embodiment of the present invention of the folding handle assembly.
Figure 6:
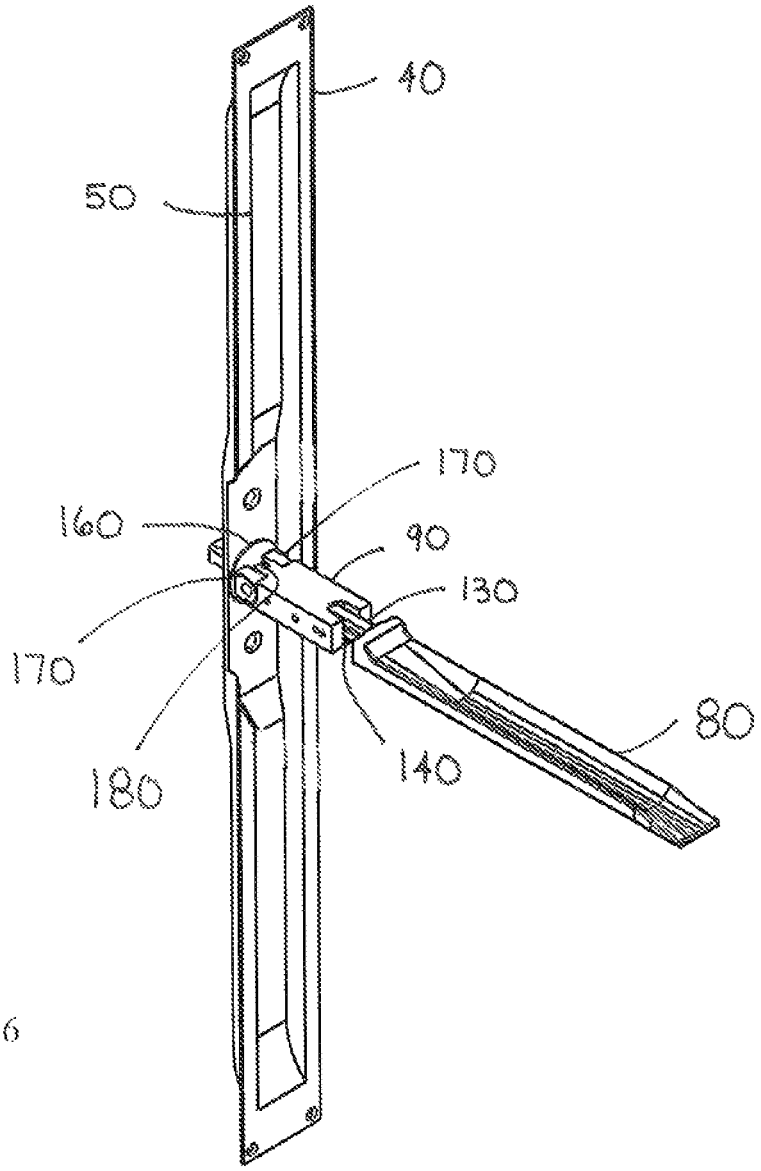
FIG. 6 is a perspective front view in accordance with one embodiment of the present invention of the folding handle assembly with the handle in the extended position.
Figure 9:
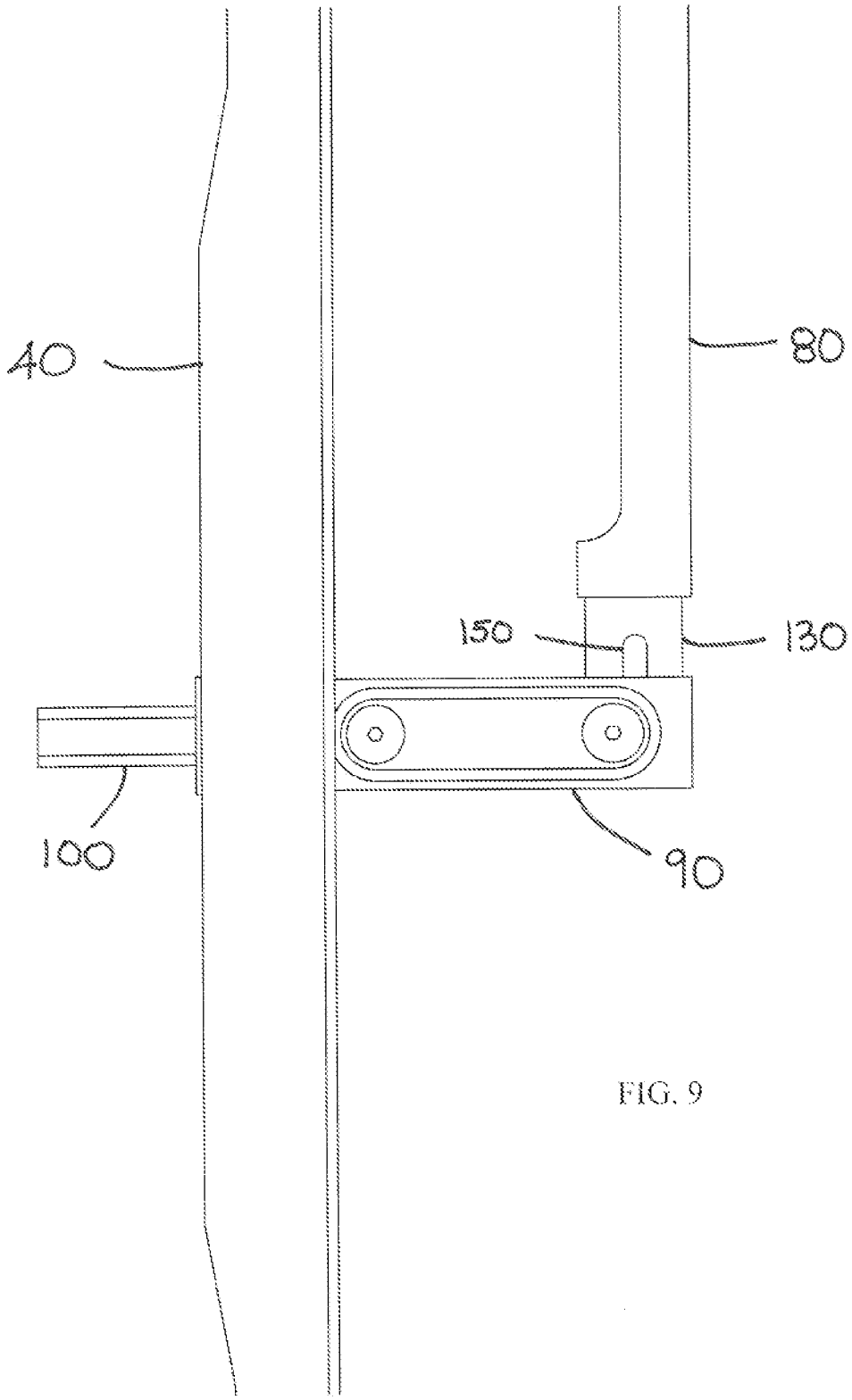
FIG. 9 is a partial side view in accordance with one embodiment of the present invention of the folding handle assembly.
Figure 10:
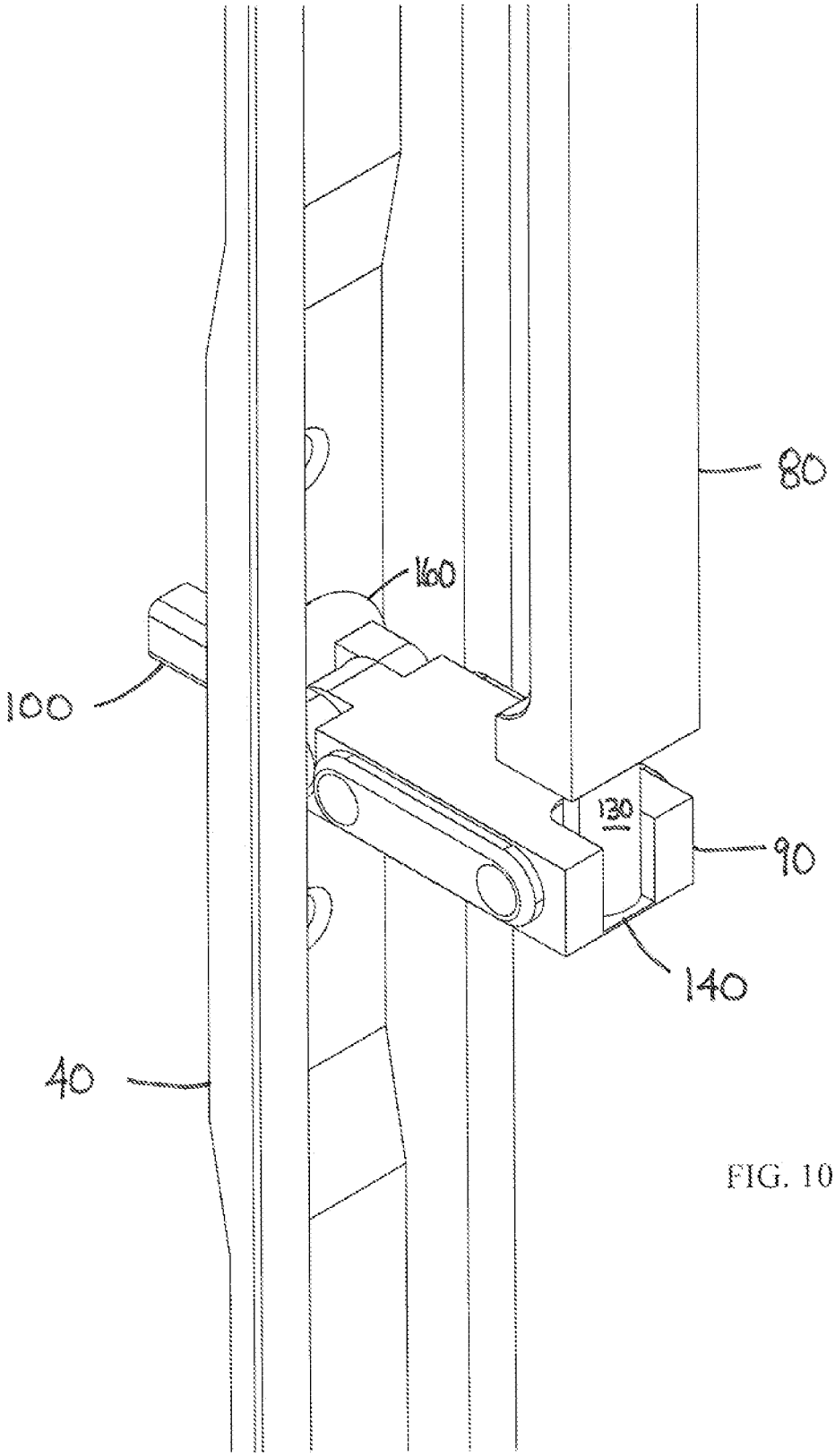
FIG. 10 is a partial perspective side view in accordance with one embodiment of the present invention of the folding handle assembly.
Figure 11:
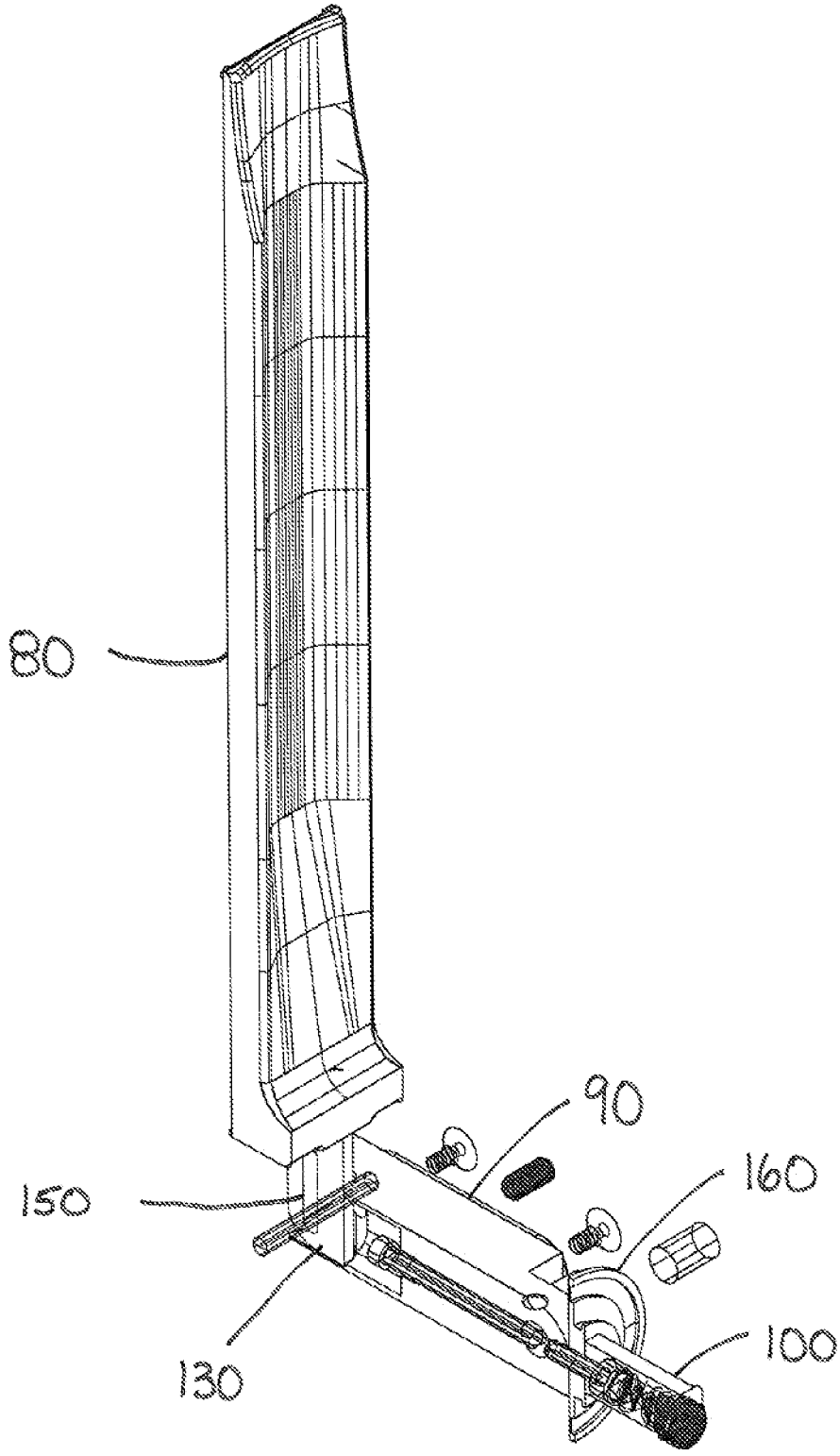
FIG. 11 is a partial cross-sectional and exploded side view in accordance with one embodiment of the present invention of the folding handle assembly.

With reference to FIGS. 4 and 11, the folding handle assembly 30 includes a lever assembly 70 for maneuvering the door 10. The lever assembly 70 has a handle or lever 80, which the operator may grip in order to use to move and lock the lift and slide door 10 in a desired position. As perhaps best shown in FIG. 6, the lever assembly 70 also includes a link 90 and a spindle 100 to aid in maneuvering the lever 80 in order to move the door 10. The lever assembly 70 is positioned within the recess 50 of the base 40 such that it does not protrude from the base when it is in a stored position. Turning to FIGS. 9 and 10, the spindle 100 is positioned substantially in the center of the base 40, which allows the handle assembly 30 to properly operate. Importantly, the lever assembly 70 may be entirely hidden from view as the base 40 is positioned substantially flush with a surface of the door 10 and the lever assembly 70 is positioned fully within the recess 50 of the base 40.

Figure 5:
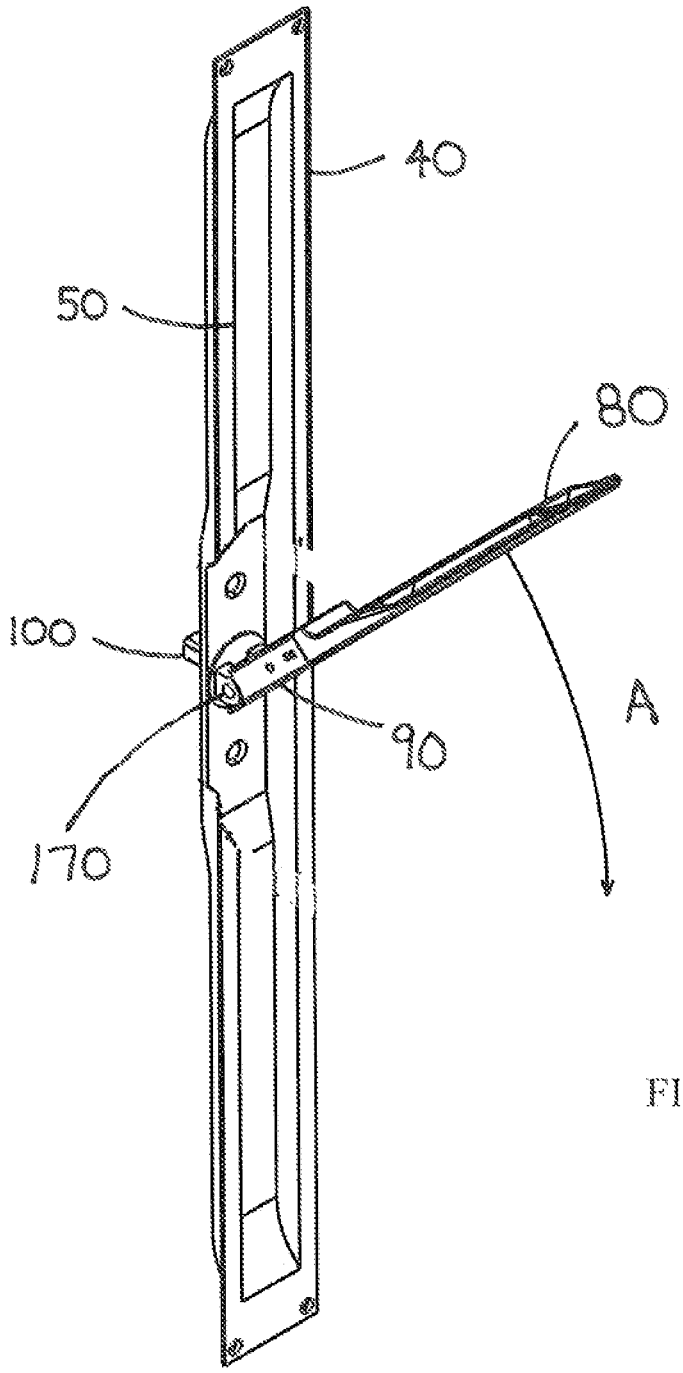
FIG. 5 is a perspective front view in accordance with one embodiment of the present invention of the folding handle assembly with the handle moving into an extended position.

The lever 80, link 90 and spindle 100 are made of a rigid material, such as steel or other like metal. Typically, these elements will be made of the same material as the rest of the foldable handle assembly 30. The lever 80 is substantially rectangular-shaped and it is tapered at a distal end 110. The tapered nature of the lever 80 allows a person to easily grab the lever and pull it downward from a stored position in the recess 50 to an operating position (as shown by the arrow A in FIG. 5). At a proximate end 120, the lever 80 has a extendable, recessed part or joint 130 which may be hingedly connected to the door 10 via link 90 (see FIG. 4). The joint 130 is typically smaller than the lever 80 and slidably extends into a U-shaped opening 140 in the link 90 and connects to the link through at least one pin or other fastener. A retraction slot 150 allows the joint 130 to extend or slide away from the link 90 to allow the lever 80 to fold upwards as discussed in more detail below.

In turn, the link 90 connects to the spindle 100 at approximately the center of the base 40 through the use of at least one pin or other fastener. The spindle 100 connected at one end to the link 90 and extends through a washer 160 into the base 40 and connects to the door 10 at an opposite end. The spindle 100 is substantially rectangular and has a pair of apertures 170 at the end opposite of the end extending through the door 10 for connecting to the link 90. To connect to the spindle 100, the link 90 has a hole 180 for mating between the pair of apertures 170 of the spindle.

Figure 7:
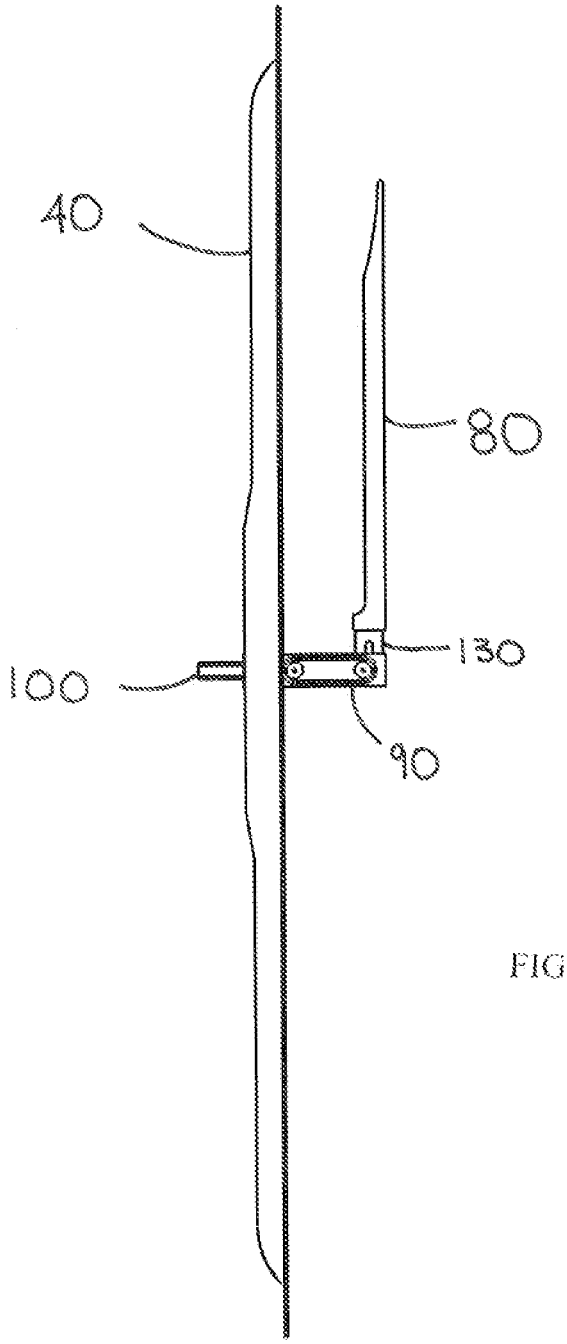
FIG. 7 is a side view in accordance with one embodiment of the present invention of the folding handle assembly.
Figure 8:
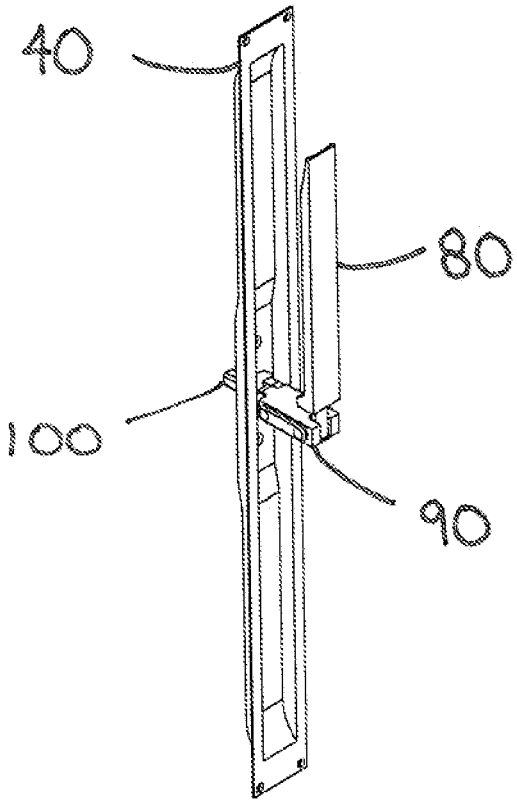
FIG. 8 is a perspective side view in accordance with one embodiment of the present invention of the folding handle assembly.

In use, the lever assembly 70 is initially positioned in a stored position in the top or bottom half of the recess 50 of the base 40 such that the handle is substantially flush with a surface of the door (see FIGS. 2 and 3). When it is desired to move the lift and slide door 10, an individual may grab the lever 80 at the tapered end and pull it downward and away from the base 40 in the direction of arrow A in FIG. 5 until the lever 80 is substantially perpendicular to the base 40 (see FIGS. 7 and 8). It should be appreciated that if the lever 80 is positioned in the bottom half of the recess, the lever may be pulled upward and away from the base until the lever is substantially perpendicular to the base. Subsequently, the lever 80 may be extended and unlocked from the link 50 along the retraction slot 150 while remaining connected to the link at a connection point 190. Then the lever 80 may be folded at approximately a 90° angle at the hinged connection between the lever and the link until the lever is substantially parallel to the base (see FIGS. 7 and 8).

As discussed above, when the lever 80 is pulled down from the storage position into an intermediate position (i.e., when the lever is substantially perpendicular to the base) and extended from the link 90, the link 90 locks into the spindle 100 such that the link remains substantially perpendicular to the base 40. The locking of the link 90 with the spindle 100 prevents movement of the link from this perpendicular position when the lever 80 is folded into the operating position (i.e., when the lever is substantially parallel to the base) and when the lever is rotated during operation, i.e., for moving the door. Advantageously, this locking feature prevents the lever from contacting the base 40, the door stile and the door glass/panels during operation.

From this operating position, the lever assembly 70 may be used to move the lift and slide door 10 as desired. In other words, the door may be opened or closed by moving the lever 80. Specifically, the lever 80 may be rotated 180° degrees around the spindle 100, which unlocks the door and lifts it up about seven millimeters (7 mm) from a weather-tight locked position and allows it to easily slide on rollers or track with minimal friction and without rubbing against any weather-stripping on the floor. Once the lift and slide door is properly positioned by the operator, the lever 80 may be rotated or pivoted back 180° degrees, if necessary. Then the lever 80 is unfolded and retracted and locked into the link 90. When the lever 80 is locked into the link 90, the link is unlocked from the spindle 100. Then, the lever 80 is lowered back into the stored position (i.e., it is substantially flush with the door) in the recess 50 of the base 40. At this point, the lift and slide door 10 is locked in a weather-tight locked position.

Advantageously, the folding handle for the lift and slide door allows for the efficient operation and smooth movement of the lift and slide door. Namely, the folding handle is easily moved back and forth from a stored position attached substantially flush to the door to an extended, operating position away from the door for moving the lift and slide door. Importantly, the stored position of the folding handle allows it to not protrude from the door. Moreover, the folding handle is able to efficiently move the door as desired by the operator.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. An apparatus for use with a door adapted to lift and slide, comprising:

a base adapted to be connected to the door; a lever assembly having a first portion and a second portion; wherein one end of the first portion pivotably connected to the door and an opposite end of the first portion extendably and pivotably connected to second portion via a joint end of the second portion, the joint end including an elongated slot wherein the elongated slot allows the second portion to pivot and extend or slide away from the first portion, the longitudinal axis of the first portion and second portion of the lever assembly foldable in a straight line when the lever assembly is fully recessed in the base such that the lever assembly does not protrude from the base; and a spindle extending through the base into the door at a first end and connecting to the first portion of the lever assembly at a second end, wherein the lever assembly is configured to extend away from the base such that said lever assembly is substantially perpendicular to the base, wherein the first portion of the lever assembly is configured to lock to the spindle when the lever assembly is positioned substantially perpendicular to the base.

2. The apparatus according to claim 1, wherein the base is substantially flush with a face of the door.

3. The apparatus according to claim 1, wherein the base includes a recess for receiving the lever assembly in a stored position.

4. The apparatus according to claim 3, wherein the lever assembly is configured to be stored in an upper portion of the recess in the base.

5. The apparatus according to claim 3, wherein the lever assembly is configured to be stored in a lower portion of the recess in the base.

6. The apparatus according to claim 1, wherein the second portion of the lever assembly has a tapered portion at a distal end.

7. The apparatus according to claim 1, wherein the second portion of the lever assembly retracts from the first portion of the lever assembly to allow the lever assembly to fold such that the second portion of the lever assembly is substantially parallel to the base for moving the door.

8. A method of using the apparatus of claim 1 to move and lock a lift and slide door.

9. A folding handle assembly for a door adapted to lift and slide, comprising:

a base for being attached to the door in a substantially flush condition, said base having a recessed portion; and a lever assembly for being connected to the base having a tapered end for moving the door and configured to be positioned in the recessed portion of the base in a stored position substantially flush to a surface of the door, wherein the lever assembly includes a first portion having a U-shaped opening and a second portion having a recessed part, said first portion pivotably connected to the base at one end opposite the U-shaped opening and the second portion extendably and pivotably connected at an opposite end of the first portion by the recessed part being slidingly receivable into the U-shaped opening of the first portion, wherein the recessed part of the second portion of the lever assembly has a retraction slot for allowing the recessed part of the second portion to extend and slide away from the first portion of the lever assembly and the longitudinal axis of the first portion and second portion of the lever assembly being foldable in a straight line when the lever assembly is fully recessed in the base such that the lever assembly does not protrude from the base.

10. The folding handle assembly according to claim 9, wherein the lever assembly is adapted for being manipulated from the stored position to an intermediate position substantially perpendicular to the base.

11. The folding handle assembly according to claim 10, wherein the lever assembly is adapted for being extended and folded from the intermediate position into an operating position substantially parallel to the base.

12. The folding handle assembly according to claim 11, wherein the retraction slot has an axis parallel to the second portion of the lever assembly.

13. The folding handle assembly according to claim 12, wherein the retraction slot allows said lever assembly to retract into the intermediate position and move to the stored position.

14. In a lift and slide door having a base connected thereto, said base having a recessed portion, the improvement comprising a folding handle assembly having a first and a second portion and configurable to fold between the first portion and the second portion, said folding handle assembly stored substantially flush to a surface of the door in the recessed portion of the base and configured to extend from the base to an operating position for moving the door, wherein the first portion is pivotably connected and lockable to the base at one end and the second portion is extendably and pivotably connected to the other end of the first portion via a joint end of the second portion having an elongated slot having an axis parallel to the second portion and the longitudinal axis of the first portion and second portion of the foldable handle assembly foldable in a straight line when the foldable handle assembly is fully recessed in the base such that the foldable handle assembly does not protrude from the base.

15. The improvement of claim 14, wherein the handle assembly folds at approximately a 90° angle at a hinged connection between the first and second portions.

16. The apparatus according to claim 1, wherein the first portion of the lever assembly is a link.

17. The apparatus according to claim 1, wherein the second portion of the lever assembly is a handle.

18. The apparatus according to claim 1, wherein the elongated slot has an axis parallel to the second portion of the lever assembly.

* * * * *